United States Patent [19]

Alberts

[11] 4,086,309

[45] Apr. 25, 1978

[54] METHOD FOR SEALING CRACKS AND CAVITIES IN DIFFERENT KINDS OF BUILDING CONSTRUCTIONS, SUCH AS BUILDING CONSTRUCTIONS IN ROCK, CONCRETE, BRICKWORK AND TIMBER

[75] Inventor: Claes Yngve Hjalmar Alberts, Bromma, Sweden

[73] Assignee: Stabilator AB, Bromma, Sweden

[21] Appl. No.: 477,264

[22] Filed: Jun. 7, 1974

[30] Foreign Application Priority Data

Jun. 15, 1973 Sweden ..... 7308458

[51] Int. Cl.[2] ..... E04B 1/16

[52] U.S. Cl. ..... 264/35; 52/744; 264/36; 264/90; 264/101

[58] Field of Search ..... 264/36, 101, 35, 90, 264/102; 52/744

[56] References Cited

U.S. PATENT DOCUMENTS

| | | | |
|---|---|---|---|
| 1,883,196 | 10/1932 | Wertz | 264/36 |
| 2,313,110 | 3/1943 | Wertz | 264/36 |
| 2,524,419 | 10/1950 | Billner | 264/36 |

*Primary Examiner*—Thomas P. Pavelko
*Attorney, Agent, or Firm*—O'Brien & Marks

[57] ABSTRACT

A method for sealing cracks and cavities in different kinds of building constructions, such as building constructions in rock, concrete, brickwork and timber is disclosed, according to which holes communicating with the cracks or cavities are driven into the building construction. These holes are sealed outwardly and put in connection with a vacuum source so that the water present in the cracks or cavities is sucked by the negative pressure in the direction towards the holes. Crack sealing material e.g. cement, epoxy tar, setting plastic, silicate based sealant or the like, is then applied to the cracks or cavities and is, due to the negative pressure prevailing in them, drawn into its sealing positions in the building construction, where it is allowed to harden or set under the influence of the negative pressure.

1 Claim, No Drawings

METHOD FOR SEALING CRACKS AND CAVITIES IN DIFFERENT KINDS OF BUILDING CONSTRUCTIONS, SUCH AS BUILDING CONSTRUCTIONS IN ROCK, CONCRETE, BRICKWORK AND TIMBER

Injecting or forcing sealing material into cracks and fissures in loose rock sections to make these sections less permeable to water has long been known in building constructions in rock. The sealant has usually been cement, and more recently even epoxy or polyester material has been used. However, it has been found possible to attain complete sealing only in exceptional cases, especially in regard to cement injection. In the area of building research it has therefore been regarded as possible to establish that the technically possible goal with primarily cement injection is limited to reducing the flow of water to values which may be regarded as acceptable in many cases. Even if epoxy and polyester materials give better penetration into narrower cracks than cement does, these materials do not, at the moment, give complete sealing acceptable from all points of view either.

Water leakage in such building constructions in rock as different kinds of tunnels in urbanized areas have also been shown on a number of occasions to cause lowering of the water table level, resulting in damage to houses and other installations. Water leakage in the tunnels has been acceptable from the point of view of the user, but in spite of this, experience has shown that even a comparatively insignificant water leakage in the tunnel can have a draining effect, and taken over a longer period it can cause lowering in the water table level of ground around the tunnels.

Apart from the risk of lowering water table level, there are certain other elements of risk in connection with water leaking into tunnels and different kinds of rock chambers. Taken over a long time, such water can namely break the rock down by washing away from the cracks small particles acting as binders to be found there. Complete sealing against encroaching water therefore also creates a stabilizing effect of the building construction walls.

Apart from the fact that cement injection in fine cracks has not been able to be carried out, this type of injection has also caused the difficulty that water leaking in has often washed away the cement from the cracks before the cement has set. This problem has also occurred with other sealing materials which have not had time to set or harden before they have been washed out of the cracks.

To prevent sealant being washed away from the cracks, especially in cement injection, but even for other kinds of injection, holes have been driven into the rock to bridge the pattern of cracks in it, and to drain the cracks. These cracks have then been sealed from the surface of the rock wall. Further draining holes have been required for larger cracks, as the water otherwise would have washed away the injection material, and no sealing effect would have been obtained.

In general, the problems in practice are the same for fine cracks. The rock surface is often damaged by blasting, which contributes to increase difficulties. Holes driven so that they bridge the crack pattern as far as possible are also used here. These holes are sealed outwardly by packers through which injecting nozzles are based. The injection material is then introduced under pressure to these sealed holes, whereupon the sealing material often quite quickly begins to seep out together with water through the surface cracks, so that it becomes unusable. Because of this, no notable injection pressure can be maintained in the rock either, and the applied pressure is dissipated together with the sealant itself. When injection is terminated, there is a great risk to begin with that water washes away the whole mass of sealant.

To counteract this situation one has so far been compelled to use wooden wedges and caulking with lead, tarred oakum or the like in the surface cracks, so that at least the surface of the rock itself has been sealed. In cement injection or injection with a suspension having solid particles, the effect has here been that sealing blockages have occurred due to the solid particles fastening at the wedges and oakum, the latter forming a kind of filter which initially lets through water and not the solid particles, but by degrees gets more and more filled up and finally forms sealing plugs.

No such plug-building effect is obtained when using an injection material not having solid particles, as no particles can fasten in the filter formed by the oakum.

Really fine surface cracks can neither be wedged nor wadded. Such cracks have therefore been sealed so far by using a possibly anchored sprayed-on concrete coating over the whole rock surface. This is also suitable for injecting of crack zones or blastdamaged rock. The water which runs or sprays out is collected to concentrated points and led off through hoses or pipes. In this work immediate-setting spray concrete must be used. However, the high content of accelerating additives in the concrete together with the presence of water gives this spray concrete lower quality. When this kind of injection is carried out, one should always consider whether the coating shall be supplemented or possibly removed and replaced with a good quality spray concrete coating. The great disadvantage with this process is however, that the spray concrete requires proper anchorage, and this can require an anchoring force of 250 tons per $m^2$, as an injection pressure of 25 kg per $cm^2$ is desirable in order that the injection material shall come well into the cracks on the rock. If the anchoring force is insufficient, the spray concrete coating can be pressed away from the surface of the rock and is then of more hindrance than use.

In building constructions taking the form of rock tunnels and rock chambers, there is also the injecting or sealing problem with the rock floor. To ensure good results with the injection or crack sealing methods known so far, the so-called "dirt" should be removed and the rock floor cleaned. This is, however, time-consuming and difficult, and these measures have been avoided as far as possible, which has meant that rock floor injections have most often taken place without being cracked.

Sealing cracks in different kinds of building constructions in rock is obviously of the greatest importance for other reasons apart from lowering water table level and unacceptable leakage, the latter seen from the point of view of the tunnel or chamber driver. It is namely also necessary to consIder the future use of the building construction. In certain rock chambers a suitable indoor climate is required, where water seepage is unacceptable. In other cases very strict demands for tightness against seepage must be made. This applies primarily to sewage tunnels and rock chamber installations for storing chemicals of different kinds, e.g. oils.

What has now been said in regard to different kinds of building constructions in rock also applies in general to different kinds of building constructions in concrete and brick, where there are also difficult crack-sealing problems. Even in timber building constructions there is often a need for crack and cavity sealing measures.

The present invention has the object of primarily defining a new method intended for sealing cracks and cavities in different kinds of building constructions, such as building constructions in rock, concrete, brickwork and timber, said method removing the aforementioned disadvantages with the previously known methods for injection or crack sealing. Secondly, the invention has the object of providing such a method which gives a reliable and insignificantly costly seal while chiefly stabilizing the surface rock. The method according to the invention is also suitable for injecting rock floors with the "dirt" remaining on them.

For these objects the method according to the invention is essentially distinguished in that holes communicating with the cracks or cavities are driven into the building construction, said holes being sealed outwardly and put in communication with a vacuum source, so that the water present in the cracks or cavities is sucked by the negative pressure in the direction towards the holes, whereupon crack sealing material, e.g. cement, epoxy tar, setting plastic, silicate-based sealant or the like is applied to the cracks or cavities, and due to the negative pressure prevailing in them is drawn into its sealing positions in the building construction, where it is allowed to harden or set under the influence of the negative pressure.

As a result of outwardly sealing the holes driven into the building construction and in communication with the cracks or cavities, and putting them in communication with a source of vacuum so that the water present in the cracks or cavities is drawn off in the direction towards the holes by the negative pressure, water seepage through the surface cracks of the building construction is circumvented, with all the advantages hereby offered. Thanks to the method according to the invention, instead of water seeping into or seeping out from a building construction, the water can now be locally led off in the directly opposite direction, e.g. from a rock chamber surface and outwards into the rock, i.e. a completely reversed condition in comparison with the water seepage prevalent in earlier sealing methods.

Another advantage lies in the fact that the prevalent negative pressure in the cracks or cavities is used to draw in the sealant itself, whereby a guarantee is obtained for better introduction into even very fine cracks, at the same time as all washing away of the sealant is avoided. According to the inventive method, the injection or sealing itself is carried out in a completely reversed way compared with what took place earlier.

By maintaining the negative pressure at least until the sealing or injecting material has set or hardened to a suitable extent, it is also ensured that sealing will be carried out correctly to the greatest possible degree.

The crack sealing material can be applied in several different ways. It can for example be applied to the surface cracks, through which it is sucked in by the negative pressure prevalent therein. But it can also be applied deeper into the building construction through holes driven for this purpose, which are in communication with the cracks under negative pressure. In both cases the sealant can also be applied under pressure, to further improve penetration into the cracks in the building construction.

To improve the injection result the crack carrying surface of the building construction can be dried before the application of sealing material.

The effect of negative pressure can be improved by the surface cracks in the building construction being covered by an impervious sheet, e.g. of plastic or rubber, extending over the crack carrying surface. This sheet will then be sucked against the crack carrying surface by the suction effect in the cracks, this effect being more easily maintained even with the help of simpler aids, e.g. a vacuum pump of smaller dimensions. The sealing material can possibly be introduced through the sheet itself, which for this purpose can be provided in different places with through-flow valves for the sealing material. It is also conceivable that the sealing material is applied on the interior of the sheet, e.g. in burstable bladders or hoses between it and the crack carry surface. These bladders or hoses can eventually be burstable by the pressure applied to them from the sheet, whereupon the out-flowing sealing material is sucked into the surface cracks by the negative pressure inside them.

Primarily water, but in some cases even some of the sealant will flow out through the holes driven into the cracks for the application of negative pressure. Separator means for water and sealant must therefore be mounted in the pipes by which these holes are in communication with the source of vacuum.

Under the protection of a comparatively superficially sealed rock wall using the method according to the invention, further sealing can be carried out in a similar way deeper into the rock. The holes driven for the negative pressure can then be made deeper, or also completely new deeper holes can be driven, and special holes for the application of the sealant can be made through the already sealed outer layer of rock.

The method according to the invention will now be more closely explained in the following with the help of an embodiment example suitable for this purpose. For this example the following assumptions are assumed to apply.

A traffic tunnel is to be made in rock. The tunnel is to go through a heavily built-up area, where practically all the rain water is taken through the drainage system. The tunnel may therefore not act to drain out rock foundations so that water table level reductions can come about, leading to damage on the buildings situated above. This problem is made worse by the rock foundation in the direction of the tunnel being found to contain water-bearing crack zones which must be sealed so that no risk will arise of water table levels being lowered. The method according to the present invention is to be used for sealing the cracks and cavities in the rock walls opened up by the tunnel.

In this situation the following measures are taken.

In the areas of the tunnel walls where the water bearing crack zones are, holes which are in communication with the cracks and cavities are drilled into the rock. These holes are driven so far into the rock that the water present in the crack pattern can, after a negative pressure has begun to be maintained in the holes, be led sufficiently far into the rock so that it does not disturb sealing the surface cracks to a sufficient depth which is primarily to be undertaken.

Thereafter these holes are outwardly sealed with the help of so-called "packers", a kind of sealing sleeve which is introduced into the holes, and through which pipes or other suitable stiff hoses lead from the inside of the holes to a vacuum supply of a suitable type for the purpose. Evacuating pumps may be used as vacuum sources for example. Due to the negative pressure hereby arising in the outwardly sealed holes, the water present in the crack system, which would otherwise have flowed out into the tunnel, is then led in the direction towards these holes and thus away from the tunnel and further into the rock instead, whereupon suitable crack sealing material such as cement, epoxy tar, setting plastic or the like is applied to the surface cracks and is sucked by the prevalent negative pressure in them to its sealing positions in the rock. In these positions, the sealant hardens or sets under the influence of continued negative pressure. After sealing or injecting is completed and has reached sufficient strength, the vacuum treatment of the rock is stopped, and the sealing which has been carried out may then be regarded as completed.

However, if so desired a further sealing deeper in the rock can be accomplished inside the one already more superficially applied as described. This is suitably carried out so that the drill holes already made are driven further into the rock to communicate with the portions of the crack system situated behind the already completed seal, whereupon a new outward sealing of the holes and a new vacuum treatment according to the above is carried out. The sealant is introduced through holes driven especially for the purpose through the already sealed-off rock. The sealant may possibly be introduced into these holes at an excess pressure, which, together with the negative pressure prevalent inside the rock, fills out the portions of the crack system situated further in the rock as effectively as possible, after water has been emptied from it as a result of the vacuum treatment.

Thanks to the method according to the invention, the cracks on the rock floor in the tunnel can be sealed in a reliable manner without the so-called "dirt" on the rock bottom needing to be removed. This is carried out in the following manner.

Holes are drilled through the dirt and into the rock bottom to communicate with the crack pattern there, which, after having the drill holes outwardly sealed and placed under negative pressure, is freed from water. The application of sealant to the crack pattern is done through special holes drilled for the purpose to a sufficient depth through the dirt, whereat the supply holes for the sealant are suitably somewhat more superficial than the holes which are sealed off and used for vacuum treatment of the crack pattern.

Taking into account that primarily water but even sealant sometimes comes into the pipes or hoses between the outwardly sealed holes in the rock and the vacuum supply, separator means must be arranged in these pipes so that damage to machinery is avoided.

To improve the quality of the seal, the portions of rock under vacuum can be dried e.g. by using hot air before the application of the sealant.

The suction effect exercised by the negative pressure in a crack pattern can be improved, e.g. by the application of an impermeable sheet of plastic or rubber being applied to the crack carrying rock surface.

The invention is not limited to the embodiment example described above, but may be modified in many ways within the scope of the claims.

What I claim is:

1. A method for sealing water conveying cracks and cavities containing water therein in building constructions in rock, concrete, brickwork and timber which comprises drilling at least one hole into said building construction adjacent said water conveying crack or cavity and in communication therewith, sealing said hole in vacuum communication with a vacuum in source, maintaining a vacuum said hole for removing the water conveyed by said crack or cavity through said hole, applying a crack or cavity sealing material to said crack or cavity while maintaining said hole in communication with said vacuum source whereby said crack or cavity sealing material is drawn into crack or cavity and hardening said crack or cavity sealing material.

* * * * *